US007630679B2

(12) United States Patent
Tawada

(10) Patent No.: US 7,630,679 B2
(45) Date of Patent: Dec. 8, 2009

(54) IMAGE FORMING APPARATUS, TONER CONTAINER, AND PROCESS CARTRIDGE

(75) Inventor: Takaaki Tawada, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 189 days.

(21) Appl. No.: 11/832,339

(22) Filed: Aug. 1, 2007

(65) Prior Publication Data

US 2008/0031666 A1 Feb. 7, 2008

(30) Foreign Application Priority Data

Aug. 2, 2006 (JP) ..... 2006-210431

(51) Int. Cl.
*G03G 21/12* (2006.01)

(52) U.S. Cl. ..... 399/360; 399/103; 399/120

(58) Field of Classification Search ..... 399/360, 399/120, 35, 101, 111, 102, 103, 105, 106, 399/123

See application file for complete search history.

(56) References Cited

U.S. PATENT DOCUMENTS 5,933,696 A * 8/1999 Howard et al. ..... 399/360
5,995,783 A * 11/1999 Garcia et al. ..... 399/120
6,987,938 B2 * 1/2006 Murakami et al. ..... 399/111
2006/0024103 A1 * 2/2006 Murakami et al. ..... 399/360
2007/0048050 A1 * 3/2007 Fahmy et al. ..... 399/360 X

FOREIGN PATENT DOCUMENTS

| | | |
|---|---|---|
| JP | 10-3248 | 1/1998 |
| JP | 2000-293024 | 10/2000 |
| JP | 2005-221825 | 8/2005 |
| JP | 2006-85112 | 3/2006 |

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

An image forming apparatus includes an image carrier, a cleaner, and a toner container. The image carrier carries a toner image to be transferred onto a sheet. The cleaner collects toner remaining on a surface of the image carrier after the toner image formed on the image carrier is transferred onto the sheet. The toner container stores the toner collected by the cleaner. In the toner container, the rotating member is provided in the container containing the toner. A rotating shaft of the rotating member penetrates a wall of the container and extends to an outside of the container. The contact portion is provided in the wall of the container, and is slidably contacted by the rotating shaft. The seal member is provided on an outer surface of the wall of the container, and seals the contact portion.

10 Claims, 3 Drawing Sheets

IMAGE FORMING APPARATUS, TONER CONTAINER, AND PROCESS CARTRIDGE

CROSS-REFERENCE TO RELATED APPLICATION

The present application is based on and claims priority to Japanese patent application No. 2006-210431 filed on Aug. 2, 2006 in the Japan Patent Office, the entire contents of which are hereby incorporated herein by reference.

BACKGROUND OF THE INVENTION

1. Field of the Invention

Exemplary aspects of the present invention relate to an image forming apparatus, a toner container, and a process cartridge, and more particularly, to an image forming apparatus, a toner container, and a process cartridge for collecting toner.

2. Description of the Related Art

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data by an electrophotographic method. For example, a charger charges a surface of a photoconductor. An optical writer emits a light beam onto the charged surface of the photoconductor to form an electrostatic latent image on the photoconductor according to the image data. A developing device develops the electrostatic latent image with a developer (e.g., toner) to form a toner image on the photoconductor. The toner image is transferred from the photoconductor onto a sheet via an intermediate transfer belt. A cleaner cleans the surface of the photoconductor after the toner image is transferred from the photoconductor. A fixing device applies heat and pressure to the sheet bearing the toner image to fix the toner image on the sheet. Thus, the toner image is formed on the sheet.

The image forming apparatus may include, a plurality of chargers, photoconductors, developing devices, and cleaners to form a color toner image on a sheet at an increased speed. For example, a tandem-type image forming apparatus includes four image forming devices each of which includes a charger, a photoconductor, a developing device, and a cleaner. The tandem-type image forming apparatus further includes an intermediate transfer belt and a cleaner for cleaning the intermediate transfer belt. Thus, the tandem-type image forming apparatus has a large size and occupies a large space.

Waste toner not used for forming an image is collected from the four photoconductors and the intermediate transfer belt by five cleaners, that is, four cleaners included in the four image forming devices and one cleaner for cleaning the intermediate transfer belt. The collected waste toner is sent to a waste toner container via a pipe. Since the five cleaners collect a substantial amount of waste toner, the waste toner container and the pipe have a large size and occupy a large space. To address this problem, the waste toner container and the pipe need to be effectively arranged so as to occupy a smaller space. Further, the waste toner container needs to be effectively filled with an increased amount of waste toner at an increased filling rate so as to have a compact size. To increase the filling rate of the waste toner container, the waste toner container may include a conveying screw or an agitator for conveying or agitating waste toner, respectively. The waster toner container may be blow-molded to reduce manufacturing costs.

When the waster toner container is blow-molded, an inner surface of a wall of the waste toner container is not formed with a mold. Thus, the inner surface of the wall may be undulated. When a conveying screw is provided inside the waste toner container, a bearing formed in the wall of the waste toner container supports a rotating shaft of the conveying screw penetrating the wall. A seal member seals the bearing. However, when the seal member contacts the undulated inner surface of the wall to seal the bearing, the seal member may not apply uniform pressure against the undulated inner surface of the wall. For example, the seal member may not properly seal the bearing at a portion where the seal member applies decreased pressure on the wall, and waste toner may adhere to the seal member, the bearing, and/or the rotating shaft of the conveying screw at a portion where the seal member applies increased pressure on the wall.

BRIEF SUMMARY OF THE INVENTION

This specification describes below an image forming apparatus according to an exemplary embodiment of the present invention. In one exemplary embodiment of the present invention, the image forming apparatus includes an image carrier, a cleaner, and a toner container. The image carrier is configured to carry a toner image to be transferred onto a sheet. The cleaner is configured to collect toner remaining on a surface of the image carrier after the toner image formed on the image carrier is transferred onto the sheet. The toner container is configured to store the toner collected by the cleaner. The toner container includes a container, a rotating member, a contact portion, and a seal member. The container is configured to contain the toner. The rotating member is disposed within the container, and includes a rotating shaft penetrating a wall of the container and extending to an outside of the container. The contact portion is provided in the wall of the container, and is slidably contacted by the rotating shaft. The seal member is provided on an outer surface of the wall of the container, and is configured to seal the contact portion.

This specification further describes below a toner container according to an exemplary embodiment of the present invention. In one exemplary embodiment of the present invention, the toner container includes a container, a rotating member, a contact portion, and a seal member. The container is configured to contain toner. The rotating member is disposed within the container, and includes a rotating shaft penetrating a wall of the container and extending to an outside of the container. The contact portion is provided in the wall of the container, and is slidably contacted by the rotating shaft. The seal member is provided on an outer surface of the wall of the container, and is configured to seal the contact portion.

This specification further describes below a process cartridge according to an exemplary embodiment of the present invention. In one exemplary embodiment of the present invention, the process cartridge is attachable to and detachable from an image forming apparatus, and includes a photoconductor and a cleaner. The photoconductor is configured to carry a toner image to be transferred onto a sheet. The cleaner is unitized with the photoconductor, and is configured to collect toner remaining on a surface of the photoconductor after the toner image formed on the photoconductor is transferred onto the sheet. The collected toner is stored in the above-described toner container.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
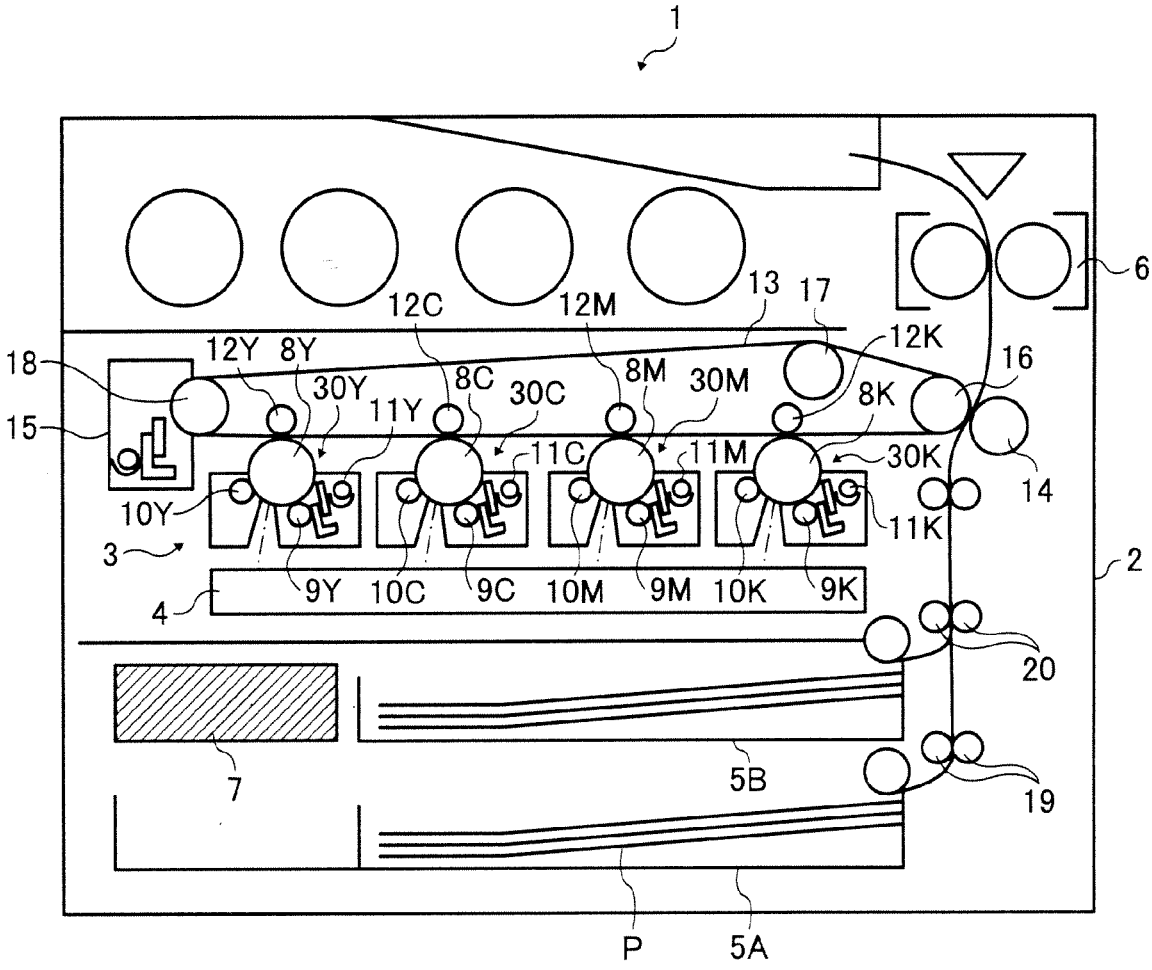
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

As illustrated in FIG. 1, the image forming apparatus 1 includes a body case 2, an optical writer 4, a printer engine 3, paper trays 5A and 5B, a conveying roller pair 19, a registration roller pair 20, a fixing device 6, and a waste toner container 7. The printer engine 3 includes process cartridges 30Y, 30C, 30M, and 30K, charging rollers 9Y, 9C, 9M, and 9K, developing devices 10Y, 10C, 10M, and 10K, an intermediate transfer belt 13, a driving roller 16, an entrance roller 17, a tension roller 18, first transfer rollers 12Y, 12C, 12M, and 12K, a second transfer roller 14, and a cleaner 15. The process cartridges 30Y, 30C, 30M, and 30K include photoconductors 8Y, 8C, 8M, and 8K and cleaners 11Y, 11C, 11M, and 11K, respectively.

The image forming apparatus 1 can be a copying machine, a facsimile machine, a printer, a multifunction printer having two or more of copying, printing, scanning, and facsimile functions, or the like. According to this non-limiting exemplary embodiment of the present invention, the image forming apparatus 1 functions as a color printer for printing a color image on a recording medium by an electrophotographic method.

The body case 2 contains the optical writer 4, the printer engine 3, the paper trays 5A and 5B, the conveying roller pair 19, the registration roller pair 20, the fixing device 6, and the waste toner container 7.

The optical writer 4 emits a light beam toward the printer engine 3 according to image data. The printer engine 3 forms a toner image and transfers the toner image onto a sheet P. In the printer engine 3, the charging rollers 9Y, 9C, 9M, and 9K, the developing devices 10Y, 10C, 10M, and 10K, and the cleaners 11Y, 11C, 11M, and 11K are arranged around the four photoconductors 8Y, 8C, 8M, and 8K, respectively.

The charging rollers 9Y, 9C, 9M, and 9K uniformly charge outer circumferential surfaces of the photoconductors 8Y, 8C, 8M, and 8K, respectively. For example, the photoconductors 8Y, 8C, 8M, and 8K have a cylindrical shape, and are connected to a driving motor (not shown). A driving force generated by the driving motor rotates the photoconductors 8Y, 8C, 8M, and 8K. Each of the photoconductors 8Y, 8C, 8M, and 8K includes a photosensitive layer on its outer circumferential surface.

The charging rollers 9Y, 9C, 9M, and 9K contact the outer circumferential surfaces of the photoconductors 8Y, 8C, 8M, and 8K, respectively. Alternatively, a small gap may be provided between the photoconductors 8Y, 8C, 8M, and 8K and the charging rollers 9Y, 9C, 9M, and 9K, respectively. A power source (not shown) applies a voltage to the charging rollers 9Y, 9C, 9M, and 9K. Corona discharge generates between the charging rollers 9Y, 9C, 9M, and 9K and the photoconductors 8Y, 8C, 8M, and 8K, respectively. Thus, the outer circumferential surfaces of the photoconductors 8Y, 8C, 8M, and 8K are uniformly charged.

The optical writer 4 emits light beams onto the charged outer circumferential surfaces of the photoconductors 8Y, 8C, 8M, and 8K to form electrostatic latent images on the outer circumferential surfaces of the photoconductors 8Y, 8C, 8M, and 8K, respectively, according to image data. The developing devices 10Y, 10C, 10M, and 10K supply toners onto the photoconductors 8Y, 8C, 8M, and 8K, respectively. The supplied toners are adhered to the electrostatic latent images formed on the outer circumferential surfaces of the photoconductors 8Y, 8C, 8M, and 8K, respectively. Thus, the electrostatic latent images are visualized as toner images. Namely, the photoconductors 8Y, 8C, 8M, and 8K serve as image carriers for carrying a toner image.

The intermediate transfer belt 13 has an endless belt-like shape, and is looped over the driving roller 16, the entrance roller 17, and the tension roller 18. The intermediate transfer belt 13 includes a resin film or a rubber. The driving roller 16 is connected to a driver (not shown). When the driver rotates the driving roller 16, the rotating driving roller 16 rotates the intermediate transfer belt 13. The rotating intermediate transfer belt 13 rotates the entrance roller 17 and the tension roller 18 by friction.

The first transfer rollers 12Y, 12C, 12M, and 12K are provided inside a loop formed by the intermediate transfer belt 13 in a manner that the first transfer rollers 12Y, 12C, 12M, and 12K face an inner circumferential surface of the intermediate transfer belt 13. The first transfer rollers 12Y, 12C, 12M, and 12K oppose the photoconductors 8Y, 8C, 8M, and 8K, respectively, via the intermediate transfer belt 13. A transfer voltage is applied to the first transfer rollers 12Y, 12C, 12M, and 12K to transfer the toner images formed on the photoconductors 8Y, 8C, 8M, and 8K, respectively, onto the intermediate transfer belt 13. For example, the toner images formed on the photoconductors 8Y, 8C, 8M, and 8K are transferred and superimposed on the intermediate transfer belt 13. Thus, a color toner image is formed on the intermediate transfer belt 13. Namely, the intermediate transfer belt 13 serves as an image carrier and intermediate transfer member for carrying a color toner image transferred from the photoconductors 8Y, 8C, 8M, and 8K.

The cleaners 11Y, 11C, 11M, and 11K clean the outer circumferential surfaces of the photoconductors 8Y, 8C, 8M, and 8K, respectively, after the toner images formed on the photoconductors 8Y, 8C, 8M, and 8K are transferred onto the intermediate transfer belt 13. Namely, the cleaners 11Y, 11C, 11M, and 11K collect residual toner and paper dust remaining on the outer circumferential surfaces of the photoconductors 8Y, 8C, 8M, and 8K as waste toner after the toner images formed on the photoconductors 8Y, 8C, 8M, and 8K are transferred onto the intermediate transfer belt 13, respectively.

The paper trays 5A and 5B load a recording medium (e.g., sheets P). The conveying roller pair 19 feeds a sheet P fed from the paper tray 5A toward the second transfer roller 14 via the registration roller pair 20. The registration roller pair 20 feeds a sheet P fed from the paper tray 5B toward the second transfer roller 14.

The second transfer roller 14 contacts the intermediate transfer belt 13 at a transfer position (e.g., a nip formed between the second transfer roller 14 and the driving roller 16 via the intermediate transfer belt 13). While a sheet P fed from the paper tray 5A or 5B passes the transfer position, a transfer voltage is applied to the second transfer roller 14 to transfer the color toner image formed on the intermediate transfer belt 13 onto the sheet P.

The sheet P bearing the color toner image is sent to the fixing device 6. The fixing device 6 applies heat and pressure to the sheet P bearing the color toner image to melt and fix the color toner image on the sheet P. The sheet P bearing the fixed color toner image is output onto an output tray (not shown) provided on a top portion of the body case 2.

The cleaner 15 cleans the outer circumferential surface of the intermediate transfer belt 13 after the color toner image formed on the intermediate transfer belt 13 is transferred onto the sheet P. Namely, the cleaner 15 collects residual toner and paper dust remaining on the outer circumferential surface of the intermediate transfer belt 13 as waste toner after the color toner image formed on the intermediate transfer belt 13 is transferred onto the sheet P. The waste toner collected by the cleaners 11Y, 11C, 11M, 11K, and 15 is sent to the waste toner container 7 and is stored in the waste toner container 7. Namely, the waste toner container 7 serves as a toner container for storing the waste toner collected by the cleaners 11Y, 11C, 11M, 11K, and 15.

The following describes operations of the image forming apparatus 1 having the above-described structure. The charging rollers 9Y, 9C, 9M, and 9K uniformly charge the outer circumferential surfaces of the photoconductors 8Y, 8C, 8M, and 8K, respectively. The optical writer 4 emits a light beam (e.g., a laser beam) onto the charged outer circumferential surfaces of the photoconductors 8Y, 8C, 8M, and 8K according to image data so as to form electrostatic latent images on the outer circumferential surfaces of the photoconductors 8Y, 8C, 8M, and 8K, respectively. The developing devices 10Y, 10C, 10M, and 10K supply a developer (e.g., yellow, cyan, magenta, and black toners) to the electrostatic latent images formed on the outer circumferential surfaces of the photoconductors 8Y, 8C, 8M, and 8K to visualize the electrostatic latent images, respectively. Thus, yellow, cyan, magenta, and black toner images are formed on the outer circumferential surfaces of the photoconductors 8Y, 8C, 8M, and 8K, respectively.

The first transfer rollers 12Y, 12C, 12M, and 12K transfer and superimpose the yellow, cyan, magenta, and black toner images formed on the photoconductors 8Y, 8C, 8M, and 8K, respectively, onto the intermediate transfer belt 13. Thus, a color toner image is formed on the intermediate transfer belt 13. The second transfer roller 14 transfers the color toner image formed on the intermediate transfer belt 13 onto a sheet P conveyed at the nip formed between the second transfer roller 14 and the driving roller 16 at a proper time corresponding to a rotating speed of the intermediate transfer belt 13. The sheet P bearing the color toner image is sent to the fixing device 6. The fixing device 6 applies heat and pressure to the sheet P bearing the color toner image to fix the color toner image on the sheet P. The sheet P bearing the fixed color toner image is output onto an outside of the image forming apparatus 1 (e.g., the output tray).

The photoconductors 8Y, 8C, 8M, and 8K included in the printer engine 3 may be unitized with at least one of the charging rollers 9Y, 9C, 9M, and 9K, the developing devices 10Y, 10C, 10M, and 10K, and the cleaners 11Y, 11C, 11M, and 11K arranged around the photoconductors 8Y, 8C, 8M, and 8K, so as to form the process cartridges 30Y, 30C, 30M, and 30K, respectively. For example, the process cartridge 30Y may form the photoconductor 8Y and at least one of the charging roller 9Y, the developing device 10Y, and the cleaner 11Y into a single unit. The process cartridges 30Y, 30C, 30M, and 30K are attachable to and detachable from the body case 2. The process cartridges 30Y, 30C, 30M, and 30K may provide easy replacement and maintenance and high precision arrangement of elements included in the process cartridges 30Y, 30C, 30M, and 30K. As a result, the image forming apparatus 1 may form a high quality image. The process cartridges 30Y, 30C, 30M, and 30K may include various combinations of elements. For example, the process cartridges 30Y, 30C, 30M, and 30K may unitize the photoconductors 8Y, 8C, 8M, and 8K with at least the cleaners 11Y, 11C, 11M, and 11K, respectively, and may be provided in the body case 2.

Figure 2A:
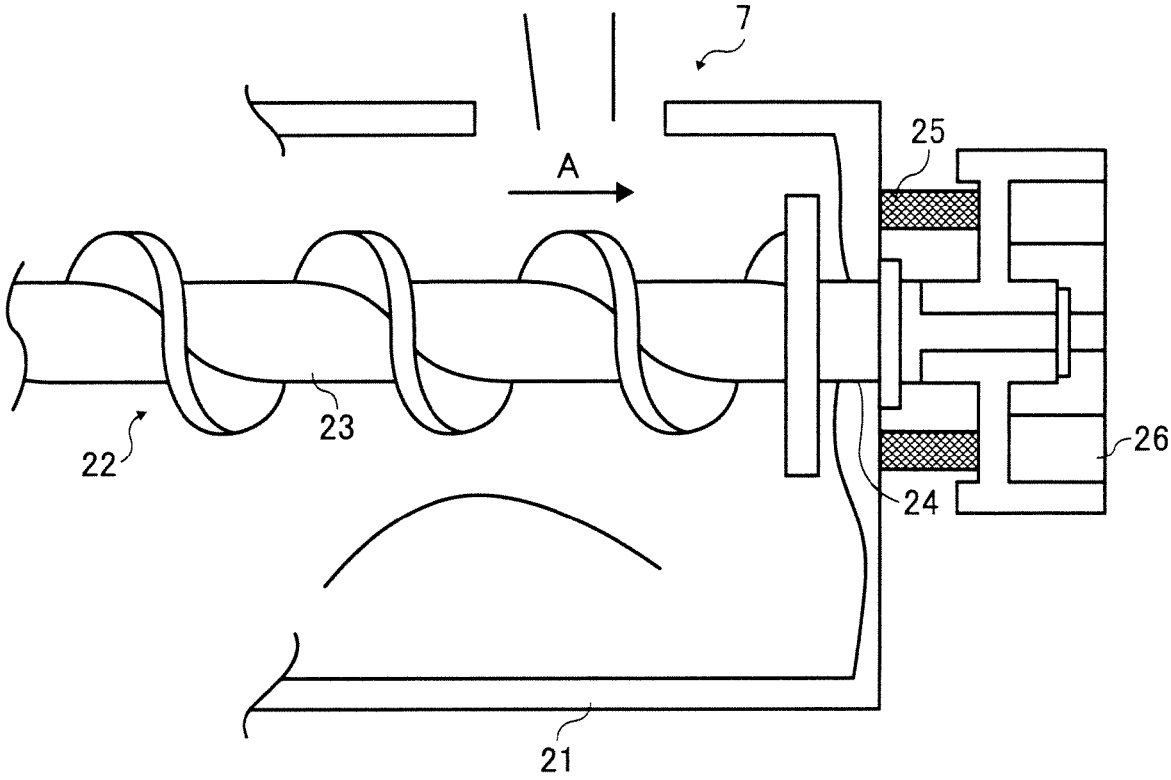
FIG. 2A is a sectional view of a waste toner container included in the image forming apparatus shown in FIG. 1.
Figure 2B:
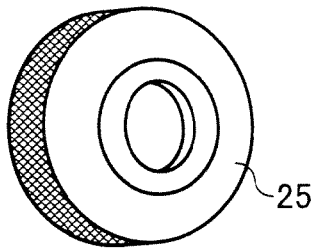
FIG. 2B is a perspective view of a seal member included in the waste toner container shown in FIG. 2A.

Referring to FIGS. 2A and 2B, the following describes the waste toner container 7. FIG. 2A is a sectional view of the waste toner container 7. As illustrated in FIG. 2A, the waste toner container 7 includes a container 21, a conveying screw 22, a bearing 24, a seal member 25, and a pulley 26. The conveying screw 22 includes a rotating shaft 23.

The container 21 contains waste toner collected by the cleaners 11Y, 11C, 11M, 11K, and 15 (depicted in FIG. 1). The conveying screw 22, serving as a rotating member, extends in a horizontal direction in the container 21. The rotating shaft 23 penetrates a wall of the container 21 and extends to an outside of the container 21. The bearing 24 is provided at a portion where the rotating shaft 23 of the conveying screw 22 penetrates the container 21, and supports the rotating shaft 23 of the conveying screw 22. Namely, the bearing 24 serves as a contact portion provided in the wall of the container 21, and slidably contacted by the rotating shaft 23. The seal member 25 is provided on an outer surface of the wall of the container 21. The pulley 26 is attached to a portion of the rotating shaft 23, which protrudes from the wall of the container 21 toward the outside of the container 21.

FIG. 2B is a perspective view of the seal member 25. As illustrated in FIG. 2B, the seal member 25 includes a sponge, for example.

As illustrated in FIG. 2A, waste toner collected by the cleaner 11Y, 11C, 11M, 11K, or 15 (depicted in FIG. 1) enters the container 21 through a waste toner entrance (not shown). When the rotating shaft 23 rotates, the conveying screw 22 conveys the waste toner in a direction A, for example. Thus, the waste toner is stored in the container 21 in a manner that the waste toner fills the container 21. The conveying screw 22 pushes the waste toner to the bearing 24. However, the pushed waste toner may not enter the seal member 25, because the seal member 25 is provided outside the container 21 in a manner that the seal member 25 contacts the outer surface of the wall of the container 21. Even when the conveying screw 22 pushes the waste toner to the bearing 24, the waste toner may not be heated and thereby may not stick or adhere to the seal member 25, the bearing 24, and/or the rotating shaft 23 of the conveying screw 22.

Figure 3A:
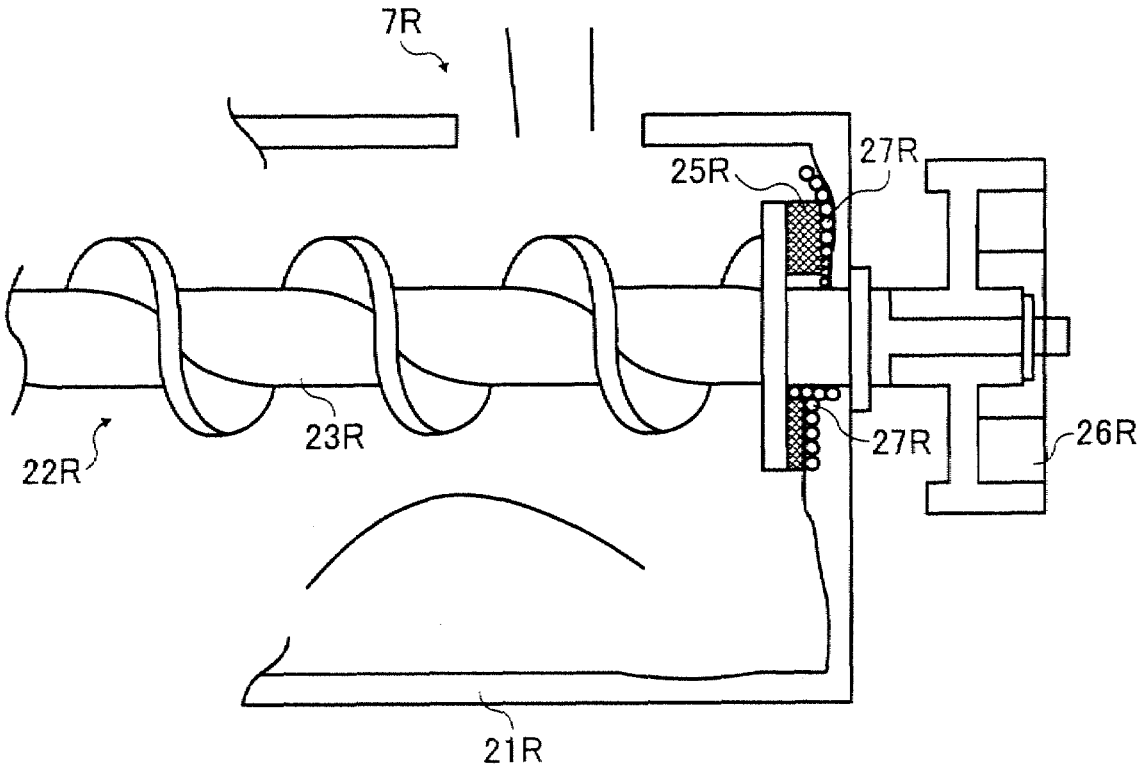
FIG. 3A is a sectional view of a reference waste toner container.
Figure 3B:
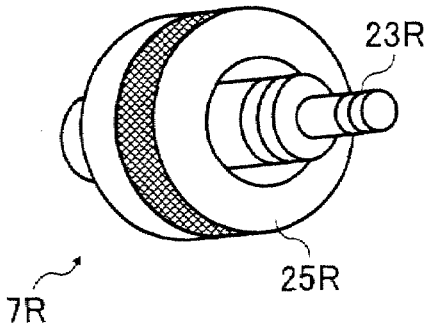
FIG. 3B is a perspective view of a seal member and a rotating shaft included in the reference waste toner container shown in FIG. 3A.

Referring to FIGS. 3A and 3B, the following describes a reference waste toner container 7R in which waste toner may easily stick or adhere to a seal member, a bearing, and/or a rotating shaft of a conveying screw. FIG. 3A is a sectional view of the reference waste toner container 7R. As illustrated in FIG. 3A, the reference waste toner container 7R includes a container 21R, a conveying screw 22R, a seal member 25R, and a pulley 26R. The conveying screw 22R includes a rotating shaft 23R.

The container 21R contains waste toner. The conveying screw 22R extends in a horizontal direction in the container 21R. The rotating shaft 23R of the conveying screw 22R penetrates a side wall of the container 21R. The pulley 26R is attached to a head portion of the rotating shaft 23R, which protrudes from the side wall of the container 21R toward an outside of the container 21R. The rotating shaft 23R is connected to a driver (not shown) via the pulley 26R. The rotating shaft 23R contacts the side wall of the container 21R at a contact portion (e.g., a bearing) which supports the rotating shaft 23R. The seal member 25R contacts an inner surface of the side wall of the container 21R, and seals the contact portion.

FIG. 3B is a perspective view of the rotating shaft 23R and the seal member 25R. The seal member 25R surrounds the rotating shaft 23R.

The container 21R is blow-molded. For example, an inner surface of walls of the container 21R is not formed with a mold. Thus, the walls have an undulated or uneven inner surface and an uneven thickness. Therefore, the conveying screw 22R may not press the seal member 25R toward the undulated inner surface of a wall (e.g., a side wall) of the container 21R with a uniform pressure. When the pressure applied by the conveying screw 22R is adjusted in accordance with a thick portion of the side wall having a great thickness, the conveying screw 22R may press the seal member 25R with a small pressure at a thin portion of the side wall having a small thickness, resulting in faulty sealing. When the pressure applied by the conveying screw 22R is adjusted in accordance with the thin portion of the side wall, the conveying screw 22R may press the seal member 25R with a great pressure at the thick portion of the side wall. Thus, when the conveying screw 22R rotates, a slide resistance generated by the rotating shaft 23R sliding on the contact portion of the side wall of the container 21R may heat and melt waste toner on the seal member 25R. The melted waste toner may stick or adhere to the seal member 25R, the bearing, and/or the rotating shaft 23R of the conveying screw 22R. The adhering waste toner is illustrated as an adhering toner 27R in FIG. 3A. When the conveying screw 22R rotates in a pressing direction in which the conveying screw 22R presses the seal member 25R toward the inner surface of the side wall of the container 21R, the conveying screw 22R presses the seal member 25R with an increased pressure. Thus, the waste toner may easily adhere or stick to the seal member 25R, the bearing, and/or the rotating shaft 23R of the conveying screw 22R.

As illustrated in FIG. 2A, according to this non-limiting exemplary embodiment, the container 21 is blow-molded. For example, an inner surface of walls of the container 21 is not formed with a mold. Thus, the walls have an undulated or uneven inner surface and an uneven thickness. To address this problem, the seal member 25 is provided on a plane outer surface, which is formed with a mold, of a wall of the container 21. The seal member 25 may be pressed toward the outer surface of the wall of the container 21 with a uniform pressure, preventing faulty sealing caused by a decreased pressure and adhesion of waste toner to the seal member 25, the bearing 24, and/or the rotating shaft 23 of the conveying screw 22 caused by an increased pressure. Thus, the seal member 25 may properly seal the bearing 24.

According to this non-limiting exemplary embodiment, in the waste toner container 7 serving as a toner container, the seal member 25 may properly seal the bearing 24 supporting the rotating shaft 23 of the conveying screw 22 serving as a rotating member. Thus, faulty sealing, which may occur when the seal member 25 presses the container 21 with a decreased pressure, may be prevented. Further, adhesion of waste toner to the seal member 25, the bearing 24, and/or the rotating shaft 23 of the conveying screw 22, which may occur when the seal member 25 is provided on an inner surface of a wall of the container 21 and presses the wall of the container 21 with an increased pressure, may be prevented.

As illustrated in FIG. 1, according to this non-limiting exemplary embodiment, in the process cartridges 30Y, 30C, 30M, and 30K, the photoconductors 8Y, 8C, 8M, and 8K are unitized with at least one element (e.g., the cleaners 11Y, 11C, 11M, and 11K) included in the process cartridges 30Y, 30C, 30M, and 30K, respectively. Thus, the process cartridges 30Y, 30C, 30M, and 30K may provide easy replacement and maintenance of elements included in the process cartridges 30Y, 30C, 30M, and 30K. Further, the process cartridges 30Y, 30C, 30M, and 30K may provide high precision arrangement of elements included in the process cartridges 30Y, 30C, 30M, and 30K. For example, the cleaners 11Y, 11C, 11M, and 11K may be properly arranged with respect to the photoconductors 8Y, 8C, 8M, and 8K, respectively.

As illustrated in FIG. 2A, according to this non-limiting exemplary embodiment, in the image forming apparatus 1 (depicted in FIG. 1), the seal member 25 applies a pressure toward the container 21 in a direction opposite to a direction in which the conveying screw 22 provided inside the container 21 conveys waste toner. Thus, a problem (e.g., adhesion of waste toner to the seal member 25, the bearing 24, and/or the rotating shaft 23 of the conveying screw 22), which may occur when the seal member 25 is provided inside the container 21 and applies an increased pressure to the container 21, may be prevented.

The image forming apparatus 1 may have any proper structure or configuration other than the above-described structure or configuration, respectively. The image forming apparatus 1 may use any proper image forming method other than the above-described method. The image forming apparatus 1 may be a printer, a copying machine, a facsimile, a plotter, or a multifunction printer including two or more of printing, copying, scanning, and facsimile functions, and may form a monochrome, multi-color, or full-color image. For example, the image forming apparatus 1 may include one or more photoconductors, and a toner image formed on the photoconductor may be directly transferred onto a sheet without being transferred onto an intermediate transfer belt.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an image carrier configured to carry a toner image to be transferred onto a sheet;

a cleaner configured to collect toner remaining on a surface of the image carrier after the toner image formed on the image carrier is transferred onto the sheet; and a toner container configured to store the toner collected by the cleaner, the toner container including a container configured to contain the toner, the container including a wall having a blow molded inner surface and a mold formed outer surface, a rotating member disposed within the container and including a rotating shaft penetrating the wall of the container and extending to an outside of the container, a contact portion provided in the wall of the container and slidably contacted by the rotating shaft, and a seal member provided on the outer surface of the wall of the container and configured to seal the contact portion.

2. The image forming apparatus according to claim 1, wherein the image carrier includes a photoconductor configured to carry the toner image.

3. The image forming apparatus according to claim 2, wherein the image carrier further includes an intermediate transfer member configured to carry the toner image transferred from the photoconductor before the toner image is further transferred onto the sheet.

4. The image forming apparatus according to claim 2, further comprising:

a process cartridge configured to form the photoconductor and the cleaner into a single unit, attachable to and detachable from the image forming apparatus, wherein the container contains waste toner collected by the cleaner from the surface of the photoconductor.

5. The image forming apparatus according to claim 1, wherein the rotating member includes a conveying screw configured to convey the toner in a horizontal direction.

6. The image forming apparatus according to claim 1, wherein the toner includes waste toner collected by the cleaner, and the container contains the waste toner.

7. A toner container, comprising:

a container configured to contain toner, the container including a wall having a blow molded inner surface and a mold formed outer surface;

a rotating member disposed within the container and including a rotating shaft penetrating the wall of the container and extending to an outside of the container;

a contact portion provided in the wall of the container and slidably contacted by the rotating shaft; and a seal member provided on the outer surface of the wall of the container and configured to seal the contact portion.

8. The toner container according to claim 7, wherein the rotating member includes a conveying screw configured to convey the toner in a horizontal direction.

9. The toner container according to claim 7, wherein the toner includes waste toner collected by a cleaner, and the container contains the waste toner.

10. A process cartridge attachable to and detachable from an image forming apparatus, the process cartridge comprising:

a photoconductor configured to carry a toner image to be transferred onto a sheet; and a cleaner unitized with the photoconductor, and configured to collect toner remaining on a surface of the photoconductor after the toner image formed on the photoconductor is transferred onto the sheet, wherein the collected toner is stored in the toner container according to claim 9.

* * * * *